United States Patent [19]

Wingen

[11] 4,434,695

[45] Mar. 6, 1984

[54] HOLDER FOR A ROLLER SLITTING KNIFE

[75] Inventor: Peter Wingen, Hauptstrabe, Fed. Rep. of Germany

[73] Assignee: Dienes Werke fur Maschinenteile GmbH & Co. KG, Hauptstrabe, Fed. Rep. of Germany

[21] Appl. No.: 329,804

[22] Filed: Dec. 11, 1981

[30] Foreign Application Priority Data

Dec. 19, 1980 [DE] Fed. Rep. of Germany ..... 3047980

[51] Int. Cl.[3] ..... B26D 7/26

[52] U.S. Cl. ..... 83/482; 83/502; 83/503; 83/699; 92/177

[58] Field of Search ..... 83/482, 500–503, 83/699; 92/177

[56] References Cited

U.S. PATENT DOCUMENTS

| | | | |
|---|---|---|---|
| 2,276,435 | 3/1942 | Thompson | 92/177 X |
| 2,983,256 | 5/1961 | Seeloff | 92/177 X |
| 3,186,281 | 6/1965 | Wingen | 83/482 X |
| 3,892,156 | 7/1975 | Johnstone | 83/482 X |
| 4,257,299 | 3/1981 | Aykut | 83/482 |
| 4,363,300 | 12/1982 | Honda | 92/177 X |

FOREIGN PATENT DOCUMENTS

| | | | |
|---|---|---|---|
| 2244421 | 3/1974 | Fed. Rep. of Germany | 83/502 |
| 1277541 | 10/1961 | France | 92/177 |

*Primary Examiner*—James M. Meister
*Attorney, Agent, or Firm*—Fay & Sharpe

[57] ABSTRACT

A holder for a roller slitting knife is provided comprising a first selectively-operable piston assembly including a first piston and a first piston cylinder housing. The first piston has a non-circular, cross-sectional portion preferably configured as a curved triangle of constant diameter received in the mating bore of the housing. A second selectively-operable piston assembly including a second piston and a second piston housing is mounted to the first assembly and disposed for operation in a direction transverse to operation of the first piston assembly. A roller slitting knife is mounted to the second piston assembly whereby the knife is selectively positioned for operation upon selective operation of the first and second piston assemblies.

12 Claims, 3 Drawing Figures

HOLDER FOR A ROLLER SLITTING KNIFE

BACKGROUND OF THE INVENTION

This invention pertains to the art of holder devices for a roller, slitting knife and more particularly to a holder device for a roller, scoring knife.

The invention is applicable to a holder device for a roller, slitting knife for slitting all types of materials and, more particularly, to a readily adjustable holder device for selective positioning while maintaining a relatively precise and optimum operational angle of attack. However, it will be appreciated to those skilled in the art that the invention can be readily adapted for use in other applications as, for example, where similar holder devices are employed for roller items.

Conventional roller knife holders are generally hydraulically or pneumatically pressurizable for adjusting the positioning and force of the roller knife against the material to be scored or slit. Typically a pressure operated blade holder for a roller cutting machine will include a selectively operable lowering piston assembly having a non-rotatable lowering piston rod. Mounted to the lowering piston rod is a setting piston assembly with a setting piston disposed for transverse movement of the lowering piston assembly. The piston rod of the setting piston is typically attached to a blade that operates as an upper blade and which may be operationally disposed oppositely of an associated lower blade of the roller cutting machine.

As already described in German Patent Specification Number 1,024,341 published Feb. 13, 1958, a plurality of such blade holders are typically mounted for axial displacement on a blade arm above the associated lower blades of a roller cutting machine. For changing the cutting width program, the upper blades are first displaced axially from the lower blades and then raised upwards and away from the lower blades. After adjusting new cutting widths on the blade arm, the upper blades are first lowered and then axially adjusted with respect to the associated lower blades which have been previously adjusted to the appropriate widths. It is particularly advantageous to maintain an angle of attack between the upper blades and the lower blades of the order of one degree in blade holders of this kind.

Various forms and types of roller slitting knife holders have heretofore been suggested and employed in the industry, all with varying degrees of success. It has been found that defects present in most prior knife holders are such that the devices themselves are of limited economic and practical value.

Prior holders have attempted to achieve maintenance of the one degree angle of attack by mounting the lowering piston rod such that rotation is inhibited by means of groove and spring members which are disposed between the lowering piston rod and its housing. Because of the fine tolerances required, the correct setting and configuration of conventional groove and spring guide means is costly to manufacture, install and maintain. In addition, the groove is typically longitudinally disposed of the lowering piston rod and may become clogged with the fine dust given off during cutting operations such that during the subsequent raising and lowering operations, the holder becomes particularly subject to jamming and inaccurate guidance. Furthermore, the lowering piston rod is typically weakened by the longitudinal groove and excessive pressures are localized at the groove which may promote system failure. The inclusion of the longitudinal groove also made it impossible for right or left handed blade holders to vary the angle of attack by plus one degree to minus one degree in either direction and therefore two different types of blade holders had to be manufactured and kept in store.

The present invention contemplates a new and improved device which overcomes all of the above referred to problems and others by providing a new holder for a roller slitting knife which is simple in design, economical to manufacture, readily adaptable to a plurality of uses with a variety of materials, easy to install, easy to adjust and remove and which provides improved guidance of a roller slitting knife during lowering and setting up of the knife.

A BRIEF SUMMARY OF THE INVENTION

In accordance with the present invention, there is provided a holder for roller slitting knife comprising a first selectively-operable piston assembly including a first piston rod in a first piston cylinder housing. The first piston rod has a non-circular, cross-sectional portion received in a mating bore of the housing. A second selectively-operable piston assembly including a second piston rod in a second piston cylinder housing is mounted to the first assembly and disposed for operation in a direction transverse to operation of the first piston assembly. A roller slitting knife is mounted to the second piston assembly whereby the knife is selectively positioned for operation upon selective operation of the first and second piston assemblies.

In accordance with another aspect of the present invention, the non-circular cross-sectional portion is selectively disassociable from a remainder of the first piston rod and includes means for locking the non-circular, cross-sectional portion to the first piston rod.

In accordance with a further aspect of the present invention, the non-circular cross-sectional portion comprises a curved triangular member of constant diameter.

In accordance with a more limited aspect of the present invention, the curved triangular member includes a receiving bore for receiving an end portion of the first piston rod. A locking pin is transversely disposed of the curved triangular member and the end portion for locking the curved triangular member to the end portion.

One benefit obtained from the present invention is a holder for a roller slitting knife which is stronger, easy to operate and in particular less prone to breakdown than previous knife holders.

Another benefit obtained from the present invention is a knife holder in which a first selectively-operable lowering piston assembly includes a lowering piston rod having a non-circular cross-sectional portion matably received in a first piston housing. The non-circular portion is preferably configured as a curved triangle of constant diameter.

A further benefit of the present invention is a knife holder which is readily convertible from a left to a right handed attack, or vice versa.

Yet another benefit of the present invention is a knife holder including a setting piston assembly having a setting piston rod non-rotatably guided for axial displacement in a journal box.

Other benefits and advantages of the subject new holder for a roller slitting knife will become apparent to those skilled in the art upon a reading and understanding of this specification.

BRIEF DESCRIPTION OF THE DRAWINGS

The invention may take physical form in certain parts and arrangements of parts, the preferred embodiment of which will be described in detail in this specification and illustrated in the accompanying drawings which form a part hereof and wherein.

DETAILED DESCRIPTION OF THE INVENTION

Figure 1:
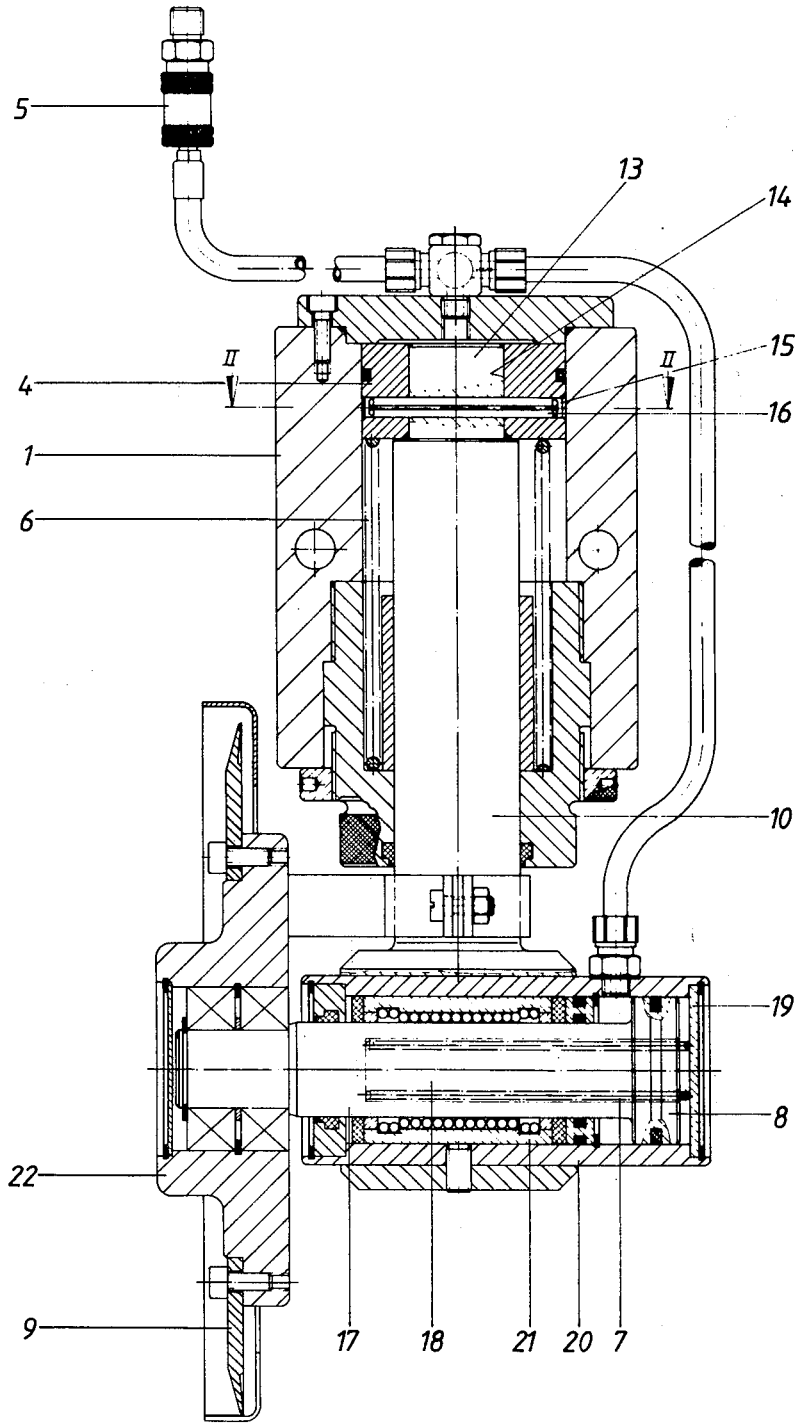
FIG. 1 is a longitudinal, cross-sectional view through a holder for a roller slitting knife which incorporates the preferred embodiment of the invention.
Figure 2:
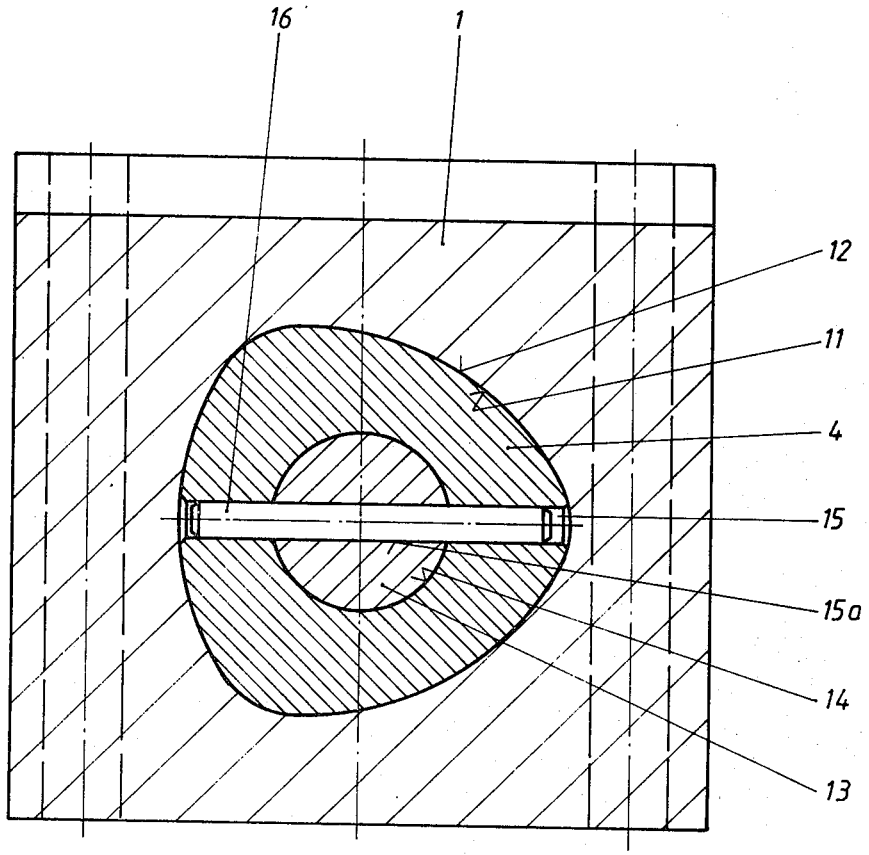
FIG. 2 is enlarged cross-sectional view of the lowering piston rod and housing take along line II—II of FIG. 1; and, FIG. 3 is a side elevational view of a blade holder formed in accordance with the present invention.
Figure 3:
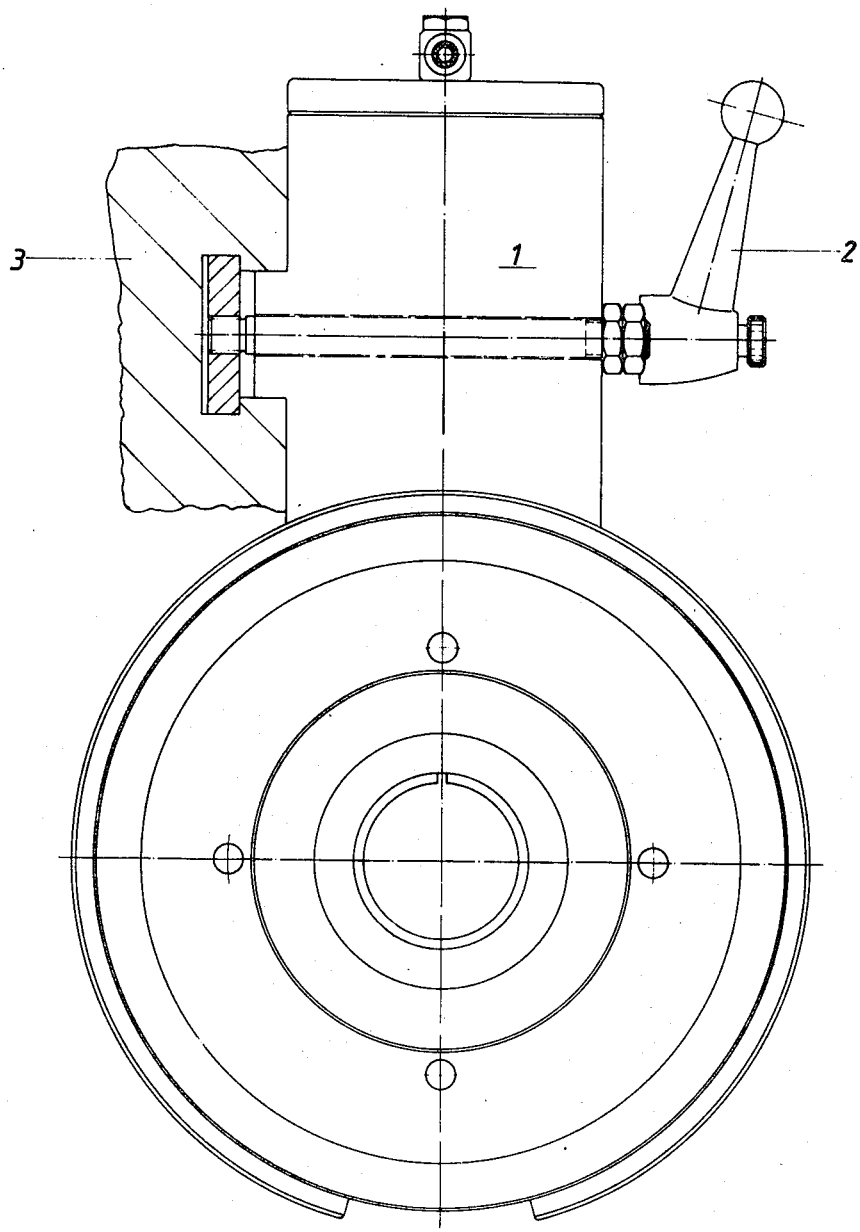

Refering now to the drawings where the showings are for purposes of illustrating the preferred embodiment of the invention only and not for purposes of limiting same, the FIGURES show a holder for a roller slitting knife having a first selectively-operable piston assembly or lowering piston including a first piston cylinder housing or lowering housing 1 and a first piston rod or lowering piston rod 10 (FIG. 1). By means of a quick tightening device 2 (FIG. 3) the lowering housing 1 of the blade holder is arranged in a known manner on a blade holder arm 3 (FIG. 3) for displacement parallel to a lower blade shaft (not shown) and for setting with respect to the particular cutting widths required. A non-circular, cross-sectional portion 4 of lowering piston rod 10 (FIGS. 1, 2) is disposed adjacent a pressurizable chamber of lowering housing 1 for selective axial movement of the piston rod 10 relative to housing 1 upon selective pressurization of the chamber. The pressurizing medium is supplied through a nipple 5 and expands the pressurizable chamber against the force of a return spring 6. The non-circular, cross-sectional portion 4 preferably comprises a curved triangular member of constant diameter (FIG. 2) which is selectively disassociable from the remainder of the first piston rod 10 and includes means for locking the non-circular cross-sectional portion to the first piston rod. The external surface 11 of the curved triangular member 4 is closely and matably received against the side wall 12 of the lowering piston housing 1 to preclude rotational movement of the lowering piston rod 10 during operation. The locking means preferably comprises a pin 16 transversely disposed of the curved triangle portion 4 which is tightly fit in radial drillings 15 of the curved triangle 4 and 15A of a spigot 13 of the lowering piston rod 10. The spigot or end portion 13 of the lowering piston rod 10 is received in a receiving bore or central drilling 14 of the curved triangle portion 4. It is a particular feature of the invention that the blade holder may be changed over from a left to right handed attack, or vice versa, by removing the tightening pin 16 and reinserting the pin after rotating the spigot 13, the lowering piston rod 10 and the parts carried thereby through 180 degrees.

The non-rotatable guidance of the lowering piston rod 10, and thus of the associated roller slitting knife or blade 9, is effected by the non-circular external shape 11 of the lowering piston curved triangle portion and of the mating lowering cylinder side wall 12 formed in the lowering housing 1. The non-rotatable coupling is achieved by the spigot 13 and the pin 16 tightly fitting in the central drilling 14 and radial drillings 15,15A.

The second selectively-operable piston assembly includes a second piston rod or setting piston rod 17 received in a second piston cylinder housing or setting piston housing 20. Setting piston rod 17 includes a closed end bore 18 for accomodating a return spring 7 supported against the terminal end cover 19 of the setting housing 20. Return spring 7 is stronger than the first piston return spring 6 so that in a known manner upon pressurization of the first pressurization chamber of the first piston assembly, the lowering piston rod 10 is lowered first and the setting piston rod 17 is extended from the setting housing 20 thereafter. The setting piston rod 17 is non-rotatably mounted in a journal box 21 in the setting piston housing 20 for displacement in an axial longitudinal direction of the housing 20 together with the setting piston end portion 8 and a blade hub 22. The upper blade 9 is screw connected to the blade hub 22 in a conventional manner. With this construction the non-rotatable guidance is transferred by lowering piston rod 10 which is arranged above the blade at such a height that it cannot be reached by the dust given off by the machine during cutting. Furthermore, the non-rotatable guide means of the curved-triangle cross-sectional portion 4 is spread over the whole of the outer surface 11 of the piston rod so that excessive local pressures such as were previously exerted on the longitudinal groove in the lowering piston rod of prior art devices are eliminated, resulting in reduced wear and tear and eliminating jamming during the lowering and raising of the blade head.

The invention has been described with reference to the preferred embodiment. Obviously, modification and alterations will occur to others upon the reading and understanding of the specification. It is my intention to include all such modification and alterations in so far as they come within the scope of the independent claims of the equivalents thereof.

Having thus described the invention, I now claim:

1. A holder for a roller slitting knife comprising:

a first selectively-operable piston assembly including a first piston rod and a first cylinder housing, said first piston rod having a reduced diameter end portion to which a non-circular, cross-sectional portion is selectively secured, said non-circular portion being received in a mating bore of said housing to prevent rotation of said first piston rod in said housing;

a second selectively-operable piston assembly including a second piston rod and a second piston cylinder housing mounted to said first assembly and disposed for operation in a direction transverse to operation of said first piston assembly; and, a roller slitting knife mounted to said second piston assembly whereby said knife is selectively positioned for operation upon selective operation of said first and second piston assemblies wherein said non-circular cross-sectional portion is selectively disassociable from a remainder of said first piston rod whereby said first piston rod can be rotated by approximately 180° to enable said knife to be converted from a right-handed attack to a left-handed attack.

2. The holder as defined in claim 1 wherein said first and second piston assemblies includes first and second pressurization chambers, respectively, for selectively pressurizing said assemblies and wherein said non-circular cross-sectional portion is disposed adjacent said first pressurization chamber.

3. The holder as defined in claim 1 wherein said non-circular, cross-sectional portion includes means for locking said non-circular, cross-sectional portion to said first piston rod.

4. The holder as defined in claim 3 wherein said non-circular, cross-sectional portion comprises a curved triangle member of constant diameter.

5. The holder as defined in claim 4 wherein said curved triangular member includes a receiving bore for receiving an end portion of said first piston rod.

6. The holder as defined in claim 5 wherein a locking pin is transversely disposed of said curved triangular member and said end portion for locking said curved triangular member to said end portion.

7. In a holder for a roller slitting knife including a first piston assembly for selective operation in a first direction and a second piston assembly for selective operation in a second direction normal to said first direction, the improvement comprising a first piston rod of said first piston assembly including a reduced diameter end portion to which is secured a piston rod portion having a cross-sectional configuration of a curved triangle of constant diameter matably received in a mating cylinder housing to preclude rotational movement of said first piston assembly during operation of said holder wherein said piston rod portion is selectively disassociable from a remainder of said first piston rod whereby said knife can be converted from a right-handed attack to a left-handed attack.

8. The holder as defined in claim 7 wherein said piston rod portion is secured by a selectively removable pin to said piston rod.

9. The holder as defined in claim 1 wherein said second piston rod is also non-rotatably mounted.

10. A selectively movable cutting mechanism, comprising:

a first selectively operable piston assembly including a first piston rod and a first cylinder housing, said first piston rod including a circular cross-sectional portion and a non-circular cross-sectional portion;

a second selectively operable piston assembly including a second piston rod and a second piston cylinder housing in which said second piston rod is non-rotatably mounted, said second assembly being mounted to said first assembly and disposed for operation in a direction transverse to the operation of said first piston assembly;

knife means for cutting material being secured to said second piston assembly; and locking means for selectively locking said non-circular cross-sectional portion to said first piston rod to prevent rotation of said first piston rod and hence said knife means wherein disengagement of said locking means enables the knife means to be rotated approximately 180° thereby converting the knife means from a right-handed attack to a left-handed attack.

11. The cutting mechanism of claim 10 wherein said first piston assembly has a circular reduced diameter end portion to which said non-circular cross-sectional portion is locked by said locking means, said non-circular cross-sectional portion having a central aperture in which said first piston reduced diameter end portion is received.

12. The cutting mechanism of claim 11 wherein said locking means includes a locking pin which is inserted through aligned apertures in both said non-circular cross-sectional portion and said reduced diameter end portion.

* * * * *